US005678729A

United States Patent [19]

Raymond

[11] Patent Number: 5,678,729

[45] Date of Patent: Oct. 21, 1997

[54] TARGET RIM AND TIP FOR CONTAINERS

[76] Inventor: Dorothy Raymond, 8203 Stone Trail Dr., Bethesda, Md. 20817

[21] Appl. No.: 528,301

[22] Filed: Sep. 14, 1995

[51] Int. Cl.[6] ..... B65D 47/18

[52] U.S. Cl. ..... 222/23; 222/212; 222/420; 215/230; 206/459.9; 604/300

[58] Field of Search ..... 222/23, 212, 420, 222/562; 604/295, 300; 206/459.5; 215/230

[56] References Cited

U.S. PATENT DOCUMENTS

| | | | |
|---|---|---|---|
| 2,053,840 | 2/1936 | Knight et al. | 222/23 |
| 2,736,316 | 2/1956 | Stovall | 604/300 |
| 4,550,866 | 11/1985 | Moore | 222/420 |
| 4,629,456 | 12/1986 | Edwards | 604/300 |
| 5,373,964 | 12/1994 | Moore | 222/420 X |
| 5,558,653 | 9/1996 | Lindstrom | 222/113 X |

*Primary Examiner*—Andres Kashnikow
*Assistant Examiner*—Kenneth Bomberg
*Attorney, Agent, or Firm*—Browdy and Neimark

[57] ABSTRACT

A container for sterile liquids such as eye medicines has a dispensing orifice nozzle with a tip and a cap for covering the tip, a rim of the cap is made visually contrasting with the outside surface of the cap, to present a target for the user to insert the tip into the un-contaminated interior of the cap without touching the tip to the rim or the outside surfaces, thus maintaining sterility of the medicine. The invention may be used when vision is blurred due to eyedrop effects or the removal of eyeglasses for administering eyedrops. Besides the cap rim, the cap interior and/or the dispensing tip may also be made contrasting. The contrast may be provided by different colors or different surface textures.

12 Claims, 2 Drawing Sheets

TARGET RIM AND TIP FOR CONTAINERS

FIELD OF THE INVENTION

The present invention relates to containers having closure caps and a protruding dispenser intended for dispensing liquids or gels, and more particularly to such containers which provide a visual target to facilitate capping of the container without contaminating the protruding dispenser.

BACKGROUND OF THE INVENTION

Many medicines or other substances in liquid, gel, or paste form are sterile and are packaged in a sterile manner. Whether the container is a squeeze bottle, a bottle with an eye dropper, or a roll-up tube, the medicine is subject to contamination when the user opens and closes it. One source of contamination is the hollow cap, generally a screw-on type, which covers the dispensing dropper, drip spout, or other opening; the cap must be handled by the user, and so dirt and germs will cover the outside and the rim of the cap. When replacing the cap on the tip, the dispensing orifice or nozzle is likely to accidentally touch the outer surface of the cap, the hand, or the rim, and the contents will be contaminated.

This is especially likely when the medicine is eye medicine. Some eye medicines blur the vision, and persons who wear corrective lenses must remove them before the medicine is administered; the attempt to re-insert the tip into the cap then is problematic.

The prior art does not address or solve the problem of contamination due to mis-aimed reinsertion of sterile tips. The Moore U.S. Pat. No. 4,550,866, shows a colored ocular dispensing tip that is intended to resemble a target when the user looks into the nozzle orifice, and is intended for aligning the eye and dropper. It is unrelated to capping or contamination avoidance.

SUMMARY OF THE INVENTION

Accordingly, the present invention has an object, among others, to overcome deficiencies in the prior art such as noted above, especially for ophthalmic ointments, gels, or liquids.

The invention thus provides a visual target for reinserting the tip, the target being a cap rim that is brightly colored, contrastingly colored relative to the cap and/or bottle, or of a contrasting visual texture relative to the cap and/or bottle. The tip, and the interior surface of the cap, may likewise be made distinguishable or noticeable by contrasting color or texture. The rim, interior, and tip may all be similarly colored and textured in contrast to the cap or body, or all mutually contrasting as well. When the sterile tip and the sterile interior of the cap are better defined, reinsertion without accidental contamination is easier.

BRIEF DESCRIPTION OF THE DRAWING

The above and other objects and the nature and advantages of the present invention will become more apparent from the following detailed description of embodiments taken in conjunction with drawings, wherein.

DETAILED DESCRIPTION OF PREFERRED EMBODIMENTS

Here, and in the following Claims:

"color", "colored", and like terms denote not only hues but also shades, tones, saturations, or other chromatic qualities and aspects embodied in these words; for example, pink and dark red are different colors even if of the same spectral hue; white and black are different colors; and red and blue are different colors although of the same saturation;

"visual texture" refers to any small-scale surface contour that is visually distinguishable, such as specular finish, dull or matte finish, pebbled or dimpled surfaces, grooves, cross-hatching, and so on.

Figure 1:
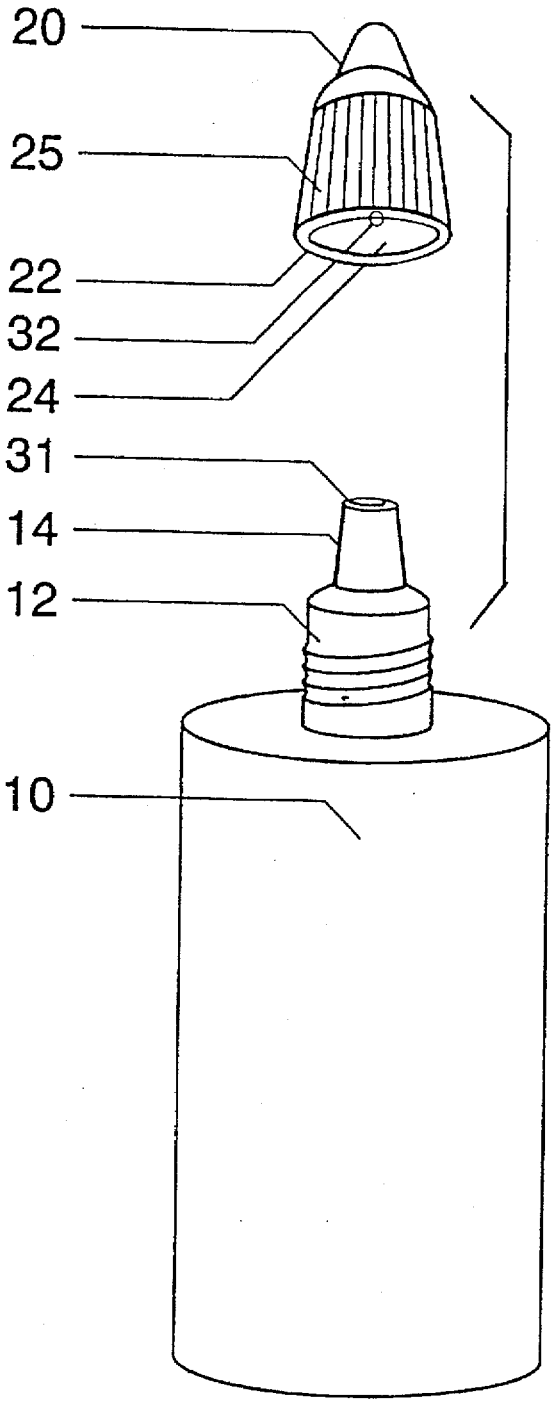
FIG. 1 is an exploded perspective view of a container and cap in accordance with the present invention.

As shown in FIG. 1, a preferred embodiment of the present invention relates to a container for ocular medicines consisting of a squeeze-type body 10, screw threads 12, and protruding dispenser, orifice, or nozzle 14 through which the medicine is dispensed. When the container is closed, the nozzle 14 is covered with a cap 20 which includes a hollow interior space 24 for accepting the nozzle 14, a rim 22 that separates the outer surface of the cap 20 from the interior surface, and threads (not shown) that mate with the threads 12 of the container body 10. As the medicine is to be used in the eye, the interior 24 of the cap 20 and the nozzle 14 are also sterile when supplied to the user.

In order to help the user guide the nozzle 14 directly into the interior 24 of the cap 20 without touching the nozzle 14 to contaminated surfaces such as the outer cap surface 25, the hand (not shown) holding the cap 20, or the rim 22 (on which the cap 20 may have been set down), the rim 22, according to the present invention, is made to be visually contrasting with the outer surface of the cap 20 (i.e., the surface excluding the interior surface and the rim itself). This is done by a surface marking or treatment that creates an area 32 of visual contrast on the rim 22.

The visual contrast is preferably by bright coloration of the rim 22, which creates a contrast with the drab, usually off-white color of the cap's outer surface as well as the typical surroundings, making the rim easier to see. (If the outer surface is black or colored, the area 32 should be white or otherwise contrastingly colored.)

The visual contrast area 32 may include as well, or instead of bright coloration, a surface texture that contrasts with the outer surface of the cap 20; for example, a smooth specular reflective area in contrast to a dull area, an area with a diffraction grating that produces iridescent colors, circular ridges that create a target effect, etc. The colors and textures may be combined.

Figure 2:
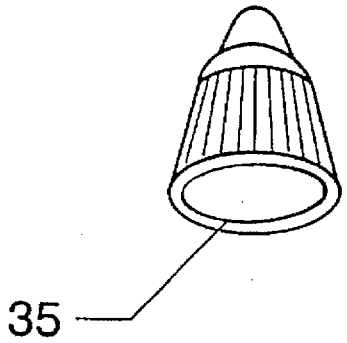
FIG. 2 is a perspective view of an alternative cap in accordance with the present invention.

The invention further contemplates that the tip of the nozzle 14 include a visually contrasting area 31 as shown in FIG. 1, and/or the interior surface of the cap 20 be a contrasting area 35 as shown in FIG. 2.

The area 32, the area 31, and the area 35 may all be visually the same, may all be mutually contrasting, or be similar and contrasting in any combination. Preferably, the interior area 35 and the rim area 32 should be different so that the rim presents a ring-like appearance for an effective target.

Besides the squeeze bottle illustrated, the invention also includes tubes (such as toothpaste tubes) that roll or crush to dispense a paste or gel, and also eye droppers that unscrew from bottles.

Figure 3:
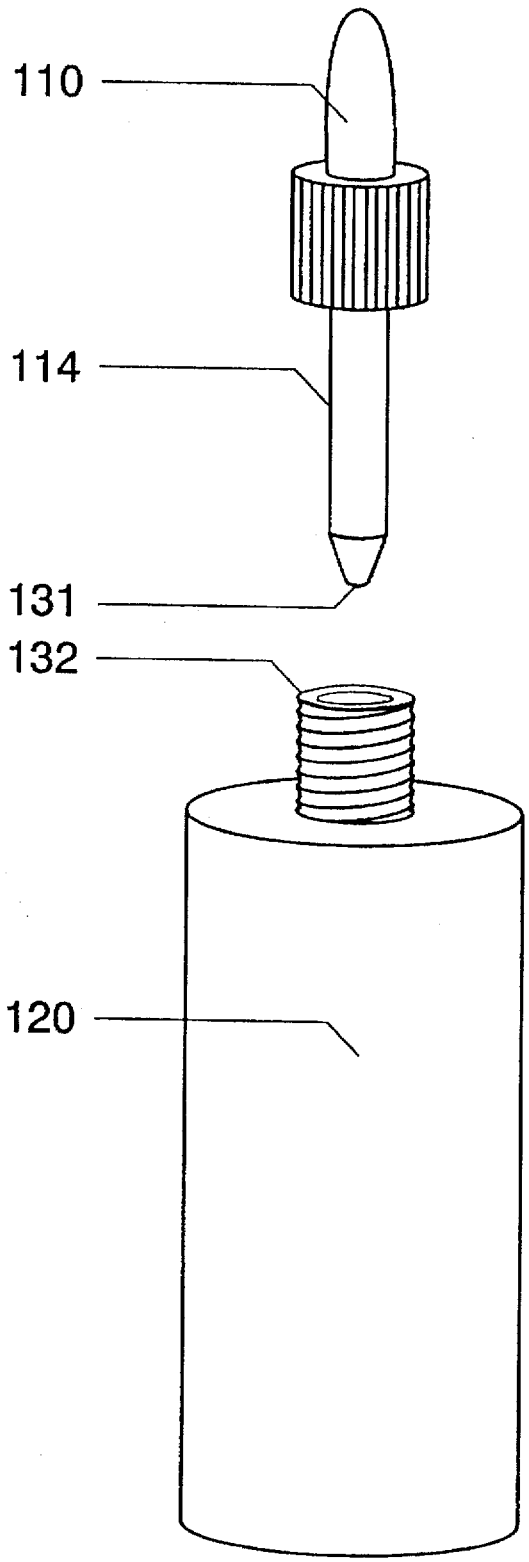
FIG. 3 is a perspective view of an alternative embodiment of the present invention.

In the case of a dropper/bottle, the squeeze bulb may be considered to be the container body, the main length of the dropper shaft may be considered the dispenser or nozzle (with a pointed tip), and the bottle may be considered as a cap with a hollow space for accepting the nozzle of the dropper within. FIG. 3 illustrates a dropper 114 dispensing substance from a bulb 110 and inserting into a bottle 120. Visually contrasting areas 131 and 132 are provided for inserting the dropper 114 into the bottle 120. Thus, the invention is not limited to containers for ocular medicines but may be used with any container having a dispensing nozzle which is maintained within the container or cap when capped and for which contamination avoidance is desired.

It will be understood that the drawing figures show only shades for surface contrast, but that all the means described are within the scope of the invention.

The invention also contemplates additional embodiments. For example, the container body may be rigid as well as flexible and squeezable. The dispenser may include any means for delivery of a substance. Such means are intended to include, but are not limited to, a spray attachment, a dispensing rod (such as for a Mercurochrome, iodine, or liquid correction fluid bottle), a mascara applicator, a rod with a brush (for dispensing such substances as nail polish), etc. Avoidance of accidental tip contact may be for the purpose of maintaining a substance in sterile or uncontaminated condition, or for avoiding contact of the substance to be delivered with other surfaces (as with nail polish or iodine). The dispensed substance may be not only liquid or gel, but also may be at least partly gaseous and/or contain immersed solid particles; thus, the substance dispensed could be solid particles carried by flowing gas, within the scope of the invention.

In general, the foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. In a container, for containing a substance, of the type having a container body, a dispenser including a tip for dispensing the substance, and a cap with a hollow, interior surface for accepting the dispenser therewithin, a rim bordering the interior surface, and a cap outer surface for handling the cap, the cap for selectively uncovering the tip from the dispenser and covering the tip to seal the dispenser; the improvement comprising:

the rim and the cap outer surface being visually contrasting;

whereby the tip may be more easily guided into the interior surface to avoid accidental contact of the tip.

2. The container according to claim 1, wherein visual contrast is obtained by at least one of contrasting colors and contrasting visual textures.

3. The container according to claim 1, wherein the interior surface includes a wall that is visually contrasting with the cap outer surface.

4. The container according to claim 3, wherein visual contrast is obtained by at least one of contrasting colors and contrasting visual textures.

5. The container according to claim 1, wherein the tip is visually contrasting with the cap outer surface.

6. The container according to claim 5, wherein visual contrast is obtained by at least one of contrasting colors and contrasting visual textures.

7. The container according to claim 1, wherein the tip is visually contrasting with a container body outer surface.

8. The container according to claim 7, wherein visual contrast is obtained by at least one of contrasting colors and contrasting visual textures.

9. The container according to claim 1, comprising the substance, and wherein the substance is liquid or gel.

10. The container according to claim 9, wherein the dispenser is a nozzle.

11. The container according to claim 1, comprising the substance, and wherein on inside of the container and the substance are sterile.

12. In a container having a container body, a cap, and a protruding delivery means for delivering a substance stored within the container, wherein the cap has a hollow inner surface for accepting therein the protruding portion of a protruding delivery means, an outer surface, and a rim disposed between said inner and outer surfaces, the improvement wherein:

said rim is visually contrasting with said outer surface.

* * * * *